US005318880A

United States Patent [19]

English et al.

[11] Patent Number: 5,318,880

[45] Date of Patent: Jun. 7, 1994

[54] METHOD OF PROCESSING A PHOTOGRAPHIC ELEMENT WITH A PERACID BLEACH

[75] Inventors: Daniel R. English, Fairport; Richard P. Szajewski, Rochester, both of N.Y.

[73] Assignee: Eastman Kodak Company, Rochester, N.Y.

[21] Appl. No.: 891,601

[22] Filed: Jun. 1, 1992

[51] Int. Cl.[5] ..... G03C 5/44; G03C 1/035

[52] U.S. Cl. ..... 430/393; 430/430; 430/461; 430/567

[58] Field of Search ..... 430/393, 430, 461, 567

[56] References Cited

U.S. PATENT DOCUMENTS

| | | | |
|---|---|---|---|
| 4,439,520 | 3/1984 | Kofron et al. | 430/434 |
| 4,695,529 | 9/1987 | Abe et al. | 430/430 |
| 4,745,048 | 5/1988 | Kishimoto et al. | 430/393 |
| 4,762,774 | 8/1988 | Kishimoto et al. | 430/393 |
| 4,780,403 | 10/1988 | Kishimoto et al. | 430/393 |
| 4,952,488 | 8/1990 | Mihayashi et al. | 430/430 |
| 5,011,763 | 4/1991 | Morimoto et al. | 430/393 |
| 5,219,715 | 6/1993 | Sowinski et al. | 430/393 |

FOREIGN PATENT DOCUMENTS 206049 6/1986 European Pat. Off. .

WO91/06037 5/1991 PCT Int'l Appl. .

OTHER PUBLICATIONS

"Kodak Persulfate Bleach For Process ECN-2", Society of Motion Picture & Television Engineers Journal, vol. 91, p. 1058, (Nov. 1982).

"Abridged Specifications For Process RVNP Using Kodak Packaged Chemicals", Eastman Kodak Company Publication H-12, (1979).

"Abridged Specifications For Process ECN-2", Eastman Kodak Compay Publication H-36, (1984).

*Primary Examiner*—Charles L. Bowers, Jr.
*Assistant Examiner*—Mark F. Huff
*Attorney, Agent, or Firm*—Sarah Meeks Roberts

[57] ABSTRACT

This invention provides a method of processing a negative color silver halide photographic element comprising taking an exposed color silver halide photographic element with a speed greater than ISO 180 or containing at least one spectrally sensitized silver halide emulsion with a tabularity greater than 100, wherein the photographic element comprises a total amount of incorporated silver and incorporated vehicle of 20 g/m$^2$ film or less; developing the exposed photographic material; and bleaching the exposed, developed photographic element with a peracid bleach in the presence of a bleach accelerator.

29 Claims, No Drawings

METHOD OF PROCESSING A PHOTOGRAPHIC ELEMENT WITH A PERACID BLEACH

FIELD OF THE INVENTION

This invention relates to a method of processing a silver halide color negative photographic element designed for rapid bleaching in peracid bleaches.

The processing of silver halide color negative elements includes a desilvering step where silver produced in the developing step is oxidized with an oxidizing agent (usually called a bleaching agent), and dissolved away with a silver ion complexing agent (usually called a fixing agent).

Some common bleaching agents are ferricyanide, dichromate, ferric chloride, ferric aminopolycarboxylate complexes and persulfate. However, generally these existing bleaches are either too weak for rapid bleaching or are potentially harmful to the environment.

One method of enhancing the bleaching ability of color light-sensitive elements is the use of bleach accelerating agents either incorporated in the elements or contained in processing solutions. This method can be unsatisfactory in that the accelerators may not provide adequate bleaching, may interfere with fixing or may require undesirable processing conditions such as high concentrations of the accelerator, exceptionally long processing times or high processing temperatures.

The above bleaching problems may be exacerbated in tabular grain emulsions such as those described in U.S. Pat. No. 4,439,520. U.S. Pat. No. 4,695,529 suggests the use of sequential bleach and bleach-fix baths to overcome this problem. U.S. Pat. No. 4,780,403 teaches that films incorporating high aspect ratio tabular grain emulsions for the purpose of achieving high sensitivity or high speed can be particularly difficult to bleach because of the sensitizing dyes adsorbed on the surface of these grains. The desilvering of such films by using a specific subset of known bleach accelerator compounds is described. U.S. Pat. No. 4,745,048 describes the desilvering of color films with relatively low quantities of incorporated silver which specifically incorporate polymeric 2-equivalent magenta dye-forming image couplers. The films are processed in the presence of a specific subset of known bleach accelerator compounds. All of these methods are inadequate in that excessively long bleach times are required. These publications further illustrate that silver halide color films are typically bleached to a similar extent by both ferric ion chelated bleaches and accelerated persulfate bleaches.

There continues to be a need for a method of bleaching color silver halide emulsions which is fast and which is ecologically desirable. There is particularly a need for improved method of bleaching high sensitivity tabular grain emulsions.

SUMMARY OF THE INVENTION

This invention provides a method of processing a negative color silver halide photographic element comprising taking an exposed color silver halide photographic element with a speed greater than ISO 180 or containing at least one spectrally sensitized silver halide emulsion with a tabularity greater than 100, wherein the photographic element comprises a total amount of incorporated silver and incorporated vehicle of 20 g/m$^2$ film or less;

developing the exposed photographic element;

and bleaching the exposed, developed photographic element with a peracid bleach in the presence of a bleach accelerator.

In one embodiment the peracid bleach is a persulfate bleach.

The advantage of this method is rapid bleaching in a bleach which has little negative impact on the environment. A further advantage is the rapid bleaching of high tabularity or high speed photographic elements.

DETAILED DESCRIPTION OF THE INVENTION

The photographic elements of this invention must have a total incorporated silver and vehicle content which is less than 20 g/m$^2$ of film. More preferable are those photographic elements having a total incorporated silver and vehicle content of less than 15 g/m$^2$. Silver halide photographic elements which meet this parameter can be rapidly bleached with peracid bleaches, particularly persulfate bleaches.

Total incorporated silver is all the silver in the photographic element including metallic silver and silver halide. In addition to image-forming silver halide this would include silver not used to capture and form an image, such as silver salts used as scavengers and metallic silver and silver salts used to absorb unwanted light. Such non-image forming silver can be located in, for example, filter layers and antihalation layers. Preferably the amount of silver in the photographic element is less than 10 g/m$^2$. More preferably the amount of silver is less than 5 g/m$^2$.

It will be obvious to those skilled in the art that the amount of silver which is utilized in the element in the form of silver halide must be adequate to form a commercially acceptable image. This amount will depend on many factors including the morphology of the grain structure, the chemical and spectral sensitization of the emulsion, and the specific combination of imaging attributes desired for a particular application. These attributes would include, inter alia, tone scale, photographic speed, granularity, sharpness and color reproduction.

The silver halide content of the film may be contained in several different emulsions within the photographic element as long as the total amount of incorporated silver plus vehicle is less than 20 g/m$^2$ of film. The amount of silver halide in the various emulsions within a single photographic element may differ. The photographic elements of this invention are those in which the silver halide content of the different emulsions in the photographic element is balanced in a manner which will result in a photographic end product which meets industry standards and consumer expectations.

Incorporated vehicle refers to the photographic gelatin and polymeric gelatin substitutes employed in forming the emulsion layers and any auxiliary film layers such as undercoats, interlayers, and overcoats. Increasing vehicle content of a color film leads to inferior bleachability in peracid bleaches. For this reason, the total quantity of silver that can be bleached in a color film composition according to this invention decreases as vehicle content is increased. The amount of vehicle used in an individual emulsion and in a photographic element is dependent on many factors known to those skilled in the art and will vary widely. The vehicle content must be high enough to form a suitable matrix but should be less than 20 g/m$^2$ for acceptable bleaching. The preferred range of vehicle content is from about 2 g/m$^2$ to 15 g/m$^2$.

The photographic speed or sensitivity of a particular silver halide crystal is typically related to the quantity of sensitizing dye in productive spectral association with the crystal. This quantity is limited by the surface area of the silver halide crystal. For this reason, spectrally sensitized silver halide emulsions with higher surface area per grain tend to have higher photographic speeds. The total surface area per grain can be directly related to the total silver halide mass per grain so long as the shape of the grain is known. For conventionally shaped silver halide emulsions, that is emulsions of low tabularity or low aspect ratio, the highest useful speeds that can be employed tend to be limited by the visually acceptable graininess associated with images made from a relatively small number of large cyrstals, by the reduced developability often encountered with crystals of low surface-to-volume ratio, and by the well known inefficiencies in latent image formation with such grains.

The introduction of spectrally sensitized high aspect ratio, high tabularity grains solves this series of problems by enabling the use of a larger number of grains of high individual surface area but of substantially lower individual mass in a photographic material. These relationships are discussed in U.S. Pat. No. 4,439,520 previously cited. Thus, use of high tabularity grains provides a useful means to achieve high sensitivity while maintaining good graininess in images. The use of a large number of high tabularity grain results in an overall higher quantity of spectral sensitizing dye now associated with a photographic material. It is this high quantity of organic dye which may be associated with desilvering difficulties, as described in U.S. Pat. No. 4,695,529.

The photographic elements of this invention have a speed greater than ISO 180 or they contain at least one spectrally sensitized emulsion with a tabularity greater than 100. Unexpectedly it has been found that increasing emulsion tabularity in a color negative photographic element improves bleachability in peracid bleaches.

Preferably the tabular grain emulsion has a tabularity of from 100 to 25,000; more preferred are those elements in which one of the emulsions has a tabularity of from 100 to 5,000; and especially preferred are elements that employ an emulsion with a tabularity of from 200 to 2,500.

Tabularity (T) is defined by the following equation:

$$T = \frac{ecd}{t^2}$$

where ecd is the average equivalent circular diameter of the tabular grains, and t is the average thickness of the tabular grains, with the dimensions being measured in microns. Tabularity thus mimics the surface to volume ratio characteristics of a silver halide crystal.

Tabular grains are those having two substantially parallel crystal faces, each of which is substantially larger than any other single crystal face of the grain. The term "substantially parallel" as used herein is intended to include surfaces that appear parallel on direct or indirect visual inspection at 10,000X magnification.

The grain characteristics described above of the silver halide emulsions of this invention can be readily ascertained by procedures well known to those skilled in the art. The equivalent circular diameter of the grain is defined as the diameter of a circle having an area equal to the projected area of the grain as viewed in photomicrograph, or an electron micrograph, of an emulsion sample. From shadowed electron micrographs of emulsion samples it is possible to determine the thickness and the diameter of each grain as well as the tabular nature of the grain. From these measurements the average thickness, the average ecd, and the tabularity can be calculated.

The silver halide photographic elements of this invention may alternatively be high speed or high sensitivity elements. Within this application, High Speed or High Sensitivity films are those with a speed rating according to the following definition of greater than ISO 180.

The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27 - 1979 (ASA speed) and relates to the exposure levels required to enable a density of 0.15 above fog in the green light sensitive and least sensitive recording unit of a multicolor negative film. This definition conforms to the International Standards Organization (ISO) film speed rating.

It is appreciated that according to the above definition, speed depends on film gamma. Color negative films intended for other than direct optical printing may be formulated or processed to achieve a gamma greater or less than 0.65. For the purposes of this application, the speeds of such films will be determined by first linearly amplifying or deamplifying the achieved density vs log exposure relationship (i.e. the gamma) to a value of 0.65 and then determining the speed according to the above definitions.

Unexpectedly it has been found that the silver halide photographic elements of this invention bleach with surprising rapidity in peracid bleaches when compared to their bleachablitiy in ferric ion chelate bleaches. The near equivalence of ferric ion chelate bleach performance to persulfate bleach performance disclosed in the prior art for other photographic elements is thus not generally predictive of the performance of the inventive photographic elements.

Typical peracid bleaches useful in this invention include the hydrogen, alkali and alkali earth salts of persulfate, peroxide, perborate, and percarbonate, oxygen, and the related perhalogen bleaches such as hydrogen, alkali and alkali earth salts of chlorate, bromate, iodate, perchlorate, perbromate and metaperiodate. Examples of formulations using these agents are described in *Research Disclosure,* December 1989, Item 308119, Published by Kenneth Mason Publications, Ltd., Dudley Annex, 12*a* North Street, Emsworth, Hampshire P010 &DQ, England, the disclosures of which are incorporated herein by reference. This publication will be identified hereafter as "Research Disclosure". Especially preferred are persulfate bleaches, particularly sodium, potassium, or ammonium persulfate. The bleaching agent can be present in any effective concentration. Preferred concentrations are from 0.01 to 1.0 moles/- liter, more preferably from 0.05 to 0.5 moles/liter of bleaching agent.

The photographic elements of this invention will bleach in a peracid bleach in 20 to 260 seconds. Normally 20 to 120 seconds is adequate for total bleaching.

Various compounds may be used to accelerate bleaching with theses peracid bleaches. Representative compounds are disclosed in U.S. Pat. Nos. 3,707,374; 3,772,020; 3,820,997; 3,870,520; 3,893,858; 4,446,225; 4,458,010; 4,506,007; 4,508,816; 4,508,817; 4,578,345; 4,865,956; 5,011,763; Research Disclosure No. 20821 (1989); Research Disclosure No. 15704 (1977); DD 141,727; DE 3,234,467; DE 3,919,550; DE 3,919,551; JP 1,292,339. These materials may be used in a pre-bath, added to the persulfate solution, or coated in the photographic element in quantities sufficient to enable bleach acceleration. Examples of preferred accelerators include dimethylaminoethanethiol, dimethylaminoethanethiol isothiouronium salt, aminoethanethiol, and morpholinoethanethiol. When used in a prebath or in the bleaching solution itself, the accelerator may be used at a concentration of 0.002 to 0.2 moles/liter, with 0.005 to 0.05 preferred. When the bleach accelerators are incorporated in the photographic element, preferred accelerators are silver morpholinoethanethiol, silver aminoethanethiol, and silver dimethylaminoethanethiol, at a concentration of 0.05 to 0.5 g/m$^2$.

Scavengers for halogen may be added to the persulfate solution as disclosed in Research Disclosure No. 17556 (1978) and U.S. Pat. Nos. 4,292,401 and 4,293,639. Other useful discussions of the application of persulfate to photographic bleaching appear in the Journal of the Society of Motion Picture and Television Engineers (SMPTE), Vol. 91, pp. 158-163 (1982); SMPTE, Vol. 91, pp. 1058-1065; and Eastman Kodak Publication H-24, "Manual for Processing Eastman Color Films" (December, 1988). Low speed or low tabularity emulsion photographic material comprising less than 20 g/m$^2$ gelatin and silver will also be readily bleached using an accelerated peracid bleach.

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like.

The silver halide emulsions employed in the elements of this invention are negative-working emulsions. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI), and development modifiers (Examples in Research Disclosure Section XXII).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

The exposed photographic elements described above can be processed by any conventional technique to produce silver by development of incorporated silver halide having dye adsorbed to its surface. In the preferred practice of the invention silver is generated imagewise while concurrently producing a dye image, and the silver is thereafter removed by bleaching while leaving the dye image. Typically, a separate pH lowering solution, referred to as a stop bath, is employed to terminate development prior to bleaching. A stabilizer bath is commonly employed for final washing and hardening of the bleached and fixed photographic element prior to drying. Conventional techniques for processing are illustrated by Research Disclosure, Paragraph XIX.

Preferred processing sequences for color photographic elements, particularly color negative films and color print papers, include the following:

(P-1) Color development→Stop→Bleaching→Washing→Fixing→Washing→Stabilizing→Drying.

(P-2) Color development→Stop→Bleaching→Fixing→Washing→Stabilizing→Drying.

(P-3) Color development→Stop-Fixing→Bleaching→Fixing→Washing→Stabilizing→Drying.

(P-4) Color development→Bleaching→Washing→Fixing→Washing→Stabilizing→Drying.

In each of processes (P-1) to (P-4) variations are contemplated. For example, a bath can be employed prior to color development, such as a prehardening bath, or the washing step can be omitted or postponed to follow the stabilizing step.

While each of the processes described above can be varied, the bleaching step is in each instance performed using a peracid-bleaching agent.

Water is employed as a solvent for the bleaching solution. The pH of the bleaching solution is maintained on the acid side of neutrality within conventional ranges, typically in the range of from about 1 to 7, more preferably from about 1.5 to 5 and most preferably from pH 2 to 4. The bleaching solution may contain a buffer consisting of an organic acid or inorganic acid and/or a salt thereof. Useful examples include phosphoric acid and salts of phosphate, citric acid and salts of citrate, boric acid and salts of borate or metaborate, acetic acid and salts of acetate.

The bleaching solution preferably contains a chloride salt such as sodium chloride, potassium chloride, or ammonium chloride, or a bromide salt such as sodium bromide, potassium bromide, or ammonium bromide. Conventional concentrations can be employed, such as from about 0.05 to 7 moles per liter, preferably from about 0.1 to 2 moles per liter.

To impart fixing properties to the bleaching solution, thereby converting it to a bleach fix solution, it is merely necessary to add a silver halide solvent. Where a separate fixing bath is employed, the fixing bath can take any convenient conventional form.

The following examples are provided to illustrate the invention and are not intended to limit it in any way.

PREPARATIVE EXAMPLE 1

(Samples 101 to 105

A color photographic recording material (Photographic Sample 101) for color negative development was prepared by applying the following layers in the given sequence to a transparent support of cellulose triacetate. The quantities of silver halide are given in g of silver per $m^2$. The quantities of other materials are given in g per $m^2$. All silver halide emulsion were stabilized with 2 grams of 4-hydroxy-6-methyl-1,3,3*a*,7-tetraazaindene per mole of silver.

Layer 1 (Annihilation Layer) black colloidal silver sol containing 0.236 g of silver and 2.44 g gelatin.

Layer 2 (First Red-Sensitive Layer) Red sensitized silver iodobromide emulsion (3.9 mol % iodide, average grain diameter 0.6 microns, average grain thickness 0.09 micron) at 0.49 g, red sensitized silver iodobromide emulsion (4 mol % iodide, average grain diameter 1.4 microns, average grain thickness 0.09 microns) at 0.21 g, cyan dye-forming image coupler C-1 at 0.538 g, Development Inhibitor Releasing (DIR) compound D-1 at 0.021 g, Bleach Accelerator Releasing (BAR) compound B-1 at 0.016 g, and cyan dye-forming masking coupler CM-1 at 0.068 g with gelatin at 1.61 g.

Layer 3 (Second Red-Sensitive Layer) Red sensitized silver iodobromide emulsion (4.1 mol % iodide, average grain diameter 2.15 microns, average grain thickness 0.075 microns) at 0.986 g, cyan dye-forming image coupler C-2 at 0.215 g, DIR compound D-1 at 0.013 g, BAR compound B-1 at 0.016 g, and cyan dye-forming masking coupler CM-1 at 0.029 g with gelatin at 1.56 g.

Layer 4 (Interlayer) Oxidized developer scavenger S-1 at 0.054 g and 0.645 g of gelatin.

Layer 5 (First Green-Sensitive Layer) Green sensitized silver iodobromide emulsion (3.5 mol % iodide, average grain diameter 0.65 microns, average thickness 0.09 microns) at 0.258 g, green sensitized silver iodobromide emulsion (4.1 mol % iodide, average grain diameter 1.2 microns, average grain thickness 0.09 microns) at 0.258 g, magenta dye forming image coupler M-1 at 0.30 g, magenta dye-forming image coupler M-2 at 0.13 g, magenta dye-forming masking coupler MM-1 at 0.069 g, DIR compound D-1 at 0.013 g with gelatin at 1.16 g.

Layer 6 (Second Green-Sensitive Layer) Green sensitized silver iodobromide emulsion (4.2 mol % iodide, average grain diameter 1.95 microns, average grain thickness 0.08 microns) at 0.968 g, magenta dye forming image coupler M-1 at 0.13 g, magenta dye-forming image coupler M-2 at 0.054 g, magenta dye-forming masking coupler MM-1 at 0.017 g, DIR compound D-2 at 0.031 g with gelatin at 1.35 g.

Layer 7 (Interlayer) Oxidized developer scavenger S-1 at 0.054 g, yellow colloidal silver at 0.0215 g with 0.645 g of gelatin.

Layer 8 (First Blue-Sensitive Layer) Blue sensitized silver iodobromide emulsion (3.6 mol % iodide, average grain diameter 0.9 microns, average thickness 0.1 micron) at 0.43 g, yellow dye-forming image coupler Y-1 at 1.08 g, DIR compound D-3 at 0.048 g, with gelatin at 1.61 g.

Layer 9 (Second Blue-Sensitive Layer) Blue sensitized silver iodobromide emulsion (2.9 mol % iodide, average grain diameter 2.8 microns, average grain thickness 0.12 microns) at 0.81 g, yellow dye-forming image coupler Y-1 at 0.323 g, DIR compound D-3 at 0.032 g, with gelatin at 1.21 g.

Layer 10 (Protective Layer 1) 0.108 g of dye UV-1, 0.118 g of dye UV-2, unsensitized silver bromide Lippman emulsion at 0.108 g, anti-matte polymethylmethacrylate beads at 0.0538 g with gelatin at 1.216 g.

This film was hardened at coating with 2% by weight to total gelatin of hardener H-1. Surfactants, coating aids, scavengers, soluble absorber dyes and stabilizers were added to the various layers of this sample as is commonly practiced in the art.

Compounds M-1, M-2 and D-2 were used as emulsions containing tricresylphosphate; compounds C-1, C-2, Y-1 and D-3 were used as emulsions containing di-n-butyl phthalate; while compound D-1 was used as an emulsion containing N-n-butyl acetanalide.

Photographic Sample 102 was like Photographic Sample 101 except that the quantity of silver (as silver halide) in layer 6 was reduced to 0.646 g, while the quantity of silver (as silver halide) in layer 5 was increased to 1.345 g.

Photographic Sample 103 was like Photographic Sample 102 except that the quantity of silver (as silver halide) in layer 2 was increased to 0.86 g.

Photographic Sample 104 was like Photographic Sample 103 except that the quantity of silver (as silver halide) in layer 3 was increased to 1.29 g.

Photographic Sample 105 was like Photographic Sample 104 except that the quantity of silver (as silver halide) in layer 6 was increased to 0.97 g.

PREPARATIVE EXAMPLE 2

Photographic Sample 106 was prepared in a manner similar to that used for Photographic Sample 101 by applying the following layers in the given sequence to a transparent support of cellulose triacetate.

Layer 1 (Antihalation Layer) black colloidal silver sol containing 0.259 g of silver, 0.075 g of dye UV-1, 0.002 g of dye MD-1, 0.016 g of dye CD-1, and 2.44 g gelatin.

Layer 2 (First Red-Sensitive Layer) Red sensitized silver iodobromide emulsion (4.8 mol % iodide, average grain diameter 0.3 microns, average grain thickness 0.1 micron) at 0.974 g, red sensitized silver iodobromide emulsion (3 mol % iodide, average grain diameter 0.7 microns, average grain thickness 0.12 microns) at 0.28 g, red sensitive silver iodobromide emulsion (6 mol iodide, average grain diameter 1.2 microns, average grain thickness 0.12 microns) at 0.91 g, cyan dye-forming image coupler C-1 at 0.72 g, DIR compound D-4 at 0.044 g, BAR compound B-1 at 0.075 g, and cyan dye-forming masking coupler CM-1 at 0.054 g with gelatin at 2.59 g.

Layer 3 (Second Red-Sensitive Layer) Red sensitized silver iodobromide emulsion (4.3 mol % iodide), average grain diameter 3.0 microns, average grain thickness 0.10 microns) at 1.29 g, cyan dye-forming image coupler C-2 at 0.23 g, DIR compound D-4 at 0.043 g, BAR compound B-1 at 0.043 g, and cyan dye-forming masking coupler CM-1 at 0.043 g with gelatin at 1.73 g.

Layer 4 (Interlayer) Dye YD-1 at 0.031 g and gelatin at 1.29 g.

Layer 5 (First Green-Sensitive Layer) Green sensitized silver iodobromide emulsion (4.8 mol % iodide, average grain diameter 0.3 microns, average thickness 0.01 microns) at 0.814 g, green sensitized silver iodobromide emulsion (3 mol % iodide, average grain diameter 0.7 microns, average grain thickness 0.12 microns) at 0.131 g, green sensitized silver iodobromide emulsion (6 mol % iodide, average grain diameter 1.3 microns, average grain thickness 0.14 microns) at 0.151 g, magenta dye-forming image coupler M-2 at 0.588 g, magenta dye-forming masking coupler MM-1 at 0.055 g, DIR compound D-2 at 0.011 g with gelatin at 2.15 g.

Layer 6 (Second Green-Sensitive Layer) Green sensitized silver iodobromide emulsion (6 mol % iodide, average grain diameter 2.5 microns, average grain thickness 0.12 microns) at 1.24 g, magenta dye-forming image coupler M-2 at 0.166 g, magenta dye-forming masking coupler MM-1 at 0.028 g, DIR compound D-2 at 0.011 g with gelatin at 1.81 g.

Layer 7 (Interlayer) Yellow colloidal silver at 0.02 g with 1.29 g of gelatin.

Layer 8 (First Blue-Sensitive Layer) Blue sensitized silver iodobromide emulsion (3 mol % iodide, average grain diameter 0.4 microns, average grain thickness 0.08 micron) at 0.34 g, blue sensitive silver iodobronide emulsion (3 mol % iodide, average grain diameter 0.8 microns, average grain thickness 0.1 micron)at 0.10 g, blue sensitive silver iodobronide emulsion (6 mol % iodide, average grain diameter 1.6 microns, average grain thickness 0.12 micron) at 0.31 g, yellow dye-forming image coupler Y-2 at 1.58 g, DIR compound D-5 at 0.083 g, with gelatin at 2.27 g.

Layer 9 (Second Blue-Sensitive Layer) Blue sensitized silver iodobromide emulsion (9 mol % iodide, average grain diameter 1 microns, average thickness 0.33 microns) at 0.74 g, yellow dye-forming image coupler Y-2 at 0.229 g, with gelatin at 1.60 g.

Layer 10 (Protective Layer 1) 0.108 g of dye UV-1, 0.118 g of dye UV-2, unsensitized silver bromide Lippman emulsion at 0.215 g, anti-matte polymethylmethacrylate beads at 0.0538 g with gelatin at 0.54 g.

This film was hardened at coating with 2% by weight to total gelatin of hardener H-1. Surfactants, coating aids, scavengers, soluble absorber dyes and stabilizers were added to the various layers of this sample as is commonly practiced in the art.

PREPARATIVE EXAMPLE 3

Sample 107

Layer 1 (Antihalation Layer) black colloidal silver sol containing 0.33 g of silver, 0.075 g of dye UV-1, 0.082 g of dye MD-1, 0.002 g of dye CD-1, 0.059 g of dye YD-1 and 2.69 g gelatin.

Layer 2 (First Red-Sensitive Layer) Red sensitized silver iodobromide emulsion (3.5 mol % iodide, average grain diameter 0.3 microns, average grain thickness 0.3 micron) at 1.4 g, red sensitized silver iodobromide emulsion (3 mol % iodide, average grain diameter 0.7 microns, average grain thickness 0.13 microns) at 1.18 g, cyan dye-forming image coupler C-1 at 0.97 g, DIR compound D-6 at 0.065 g, BAR compound B-1 at 0.011 g, and cyan dye-forming masking coupler CM-1 at 0.054 g with gelatin at 3.0 g.

Layer 3 (Second Red-Sensitive Layer) Red sensitized silver iodobromide emulsion (6 mol % iodide), average grain diameter 1.4 microns, average grain thickness 0.11 microns) at 0.81 g, cyan dye-forming image coupler C-1 at 0.054 g, DIR compound D-7 at 0.065 g, DIR compound D-6 at 0.1 g, and cyan dye-forming masking coupler CM-1 at 0.043 g with gelatin at 1.43 g.

Layer 4 (Interlayer) Dye YD-1 at 0.031 g, scavenger S-2 at 0.054 and gelatin at 1.29 g.

Layer 5 (First Green-Sensitive Layer) Green sensitized silver iodobromide emulsion (1.5 mol % iodide, average grain diameter 0.45 microns, average thickness 0.1 microns) at 0.50 g, green sensitized silver iodobromide emulsion (6 mol % iodide, average grain diameter 0.58 microns, average grain thickness 0.09 microns) at 0.45 g, DIR compound D-2 at 0.054 g with gelatin at 1.65 g.

Layer 6 (Second Green-Sensitive Layer) Green sensitized silver iodobromide emulsion (3 mol % iodide, average grain diameter 0.78 microns, average grain thickness 0.13 microns) at 0.75 g, green sensitized silver iodobromide emulsion (3 mol % iodide, average grain diameter 1 microns, average grain thickness 0.12 microns) at 0.54 g, magenta dye-forming image coupler M-2 at 0.15 g, magenta dye-forming masking coupler MM-1 at 0.108 g, with gelatin at 1.32 g.

Layer 7 (Interlayer) Yellow colloidal silver at 0.03 g, scavenger S-2 at 0.054g with 0.86 g of gelatin.

Layer 8 (First Blue-Sensitive Layer) Blue sensitized silver iodobromide emulsion (3 mol % iodide, average grain diameter 0.34 microns, average grain thickness 0.11 micron) at 0.38 g, blue sensitive silver iodobromide emulsion (3 mol % iodide, average grain diameter 0.56 microns, average grain thickness 0.11 microns) at 0.11 g, yellow dye-forming image coupler Y-1 at 0.86 g, DIR compound D-3 at 0.168 g, gelatin at 1.77 g.

Layer 9 (Second Blue-Sensitive Layer) Blue sensitized silver iodobromide emulsion (3 mol % iodide, average grain diameter 1.2 microns, average thickness 0.11 microns) at 0.43 g, yellow dye-forming image coupler Y-1 at 0.34 g, DIR compound D-3 at 0.095 with gelatin at 1.8 g.

Layer 10 (Protective Layer 1) 0.108 g of dye UV-1, 0.118 g of dye UV-2, unsensitized silver bromide Lippman emulsion at 0.215 g with gelatin at 0.54 g.

Layer 11 (Protective Layer 2) Anti-matte polymethylmethacrylate beads at 0.054 g, gelatin at 0.88 g.

This film was hardened at coating with 1.7% by weight to total gelatin of hardener H-1. Surfactants, coating aids, scavengers, soluble absorber dyes and stabilizers were added to the various layers of this sample as is commonly practiced in the art.

PREPARATIVE EXAMPLE 4

Photographic Sample 108 was prepared in a manner similar to that used for Photographic Sample 107 by applying the following layers in the given sequence to a transparent support of cellulose triacetate.

Layer 1 (Antihalation Layer) black colloidal silver sol containing 0.236 g of silver and 2.44 g gelatin.

Layer 2 (First Red-Sensitive Layer) Red sensitized silver iodobromide emulsion (2.5 mol % iodide, average grain diameter 0.7 microns, average grain thickness 0.09 micron) at 0.19 g, red sensitized silver iodobromide emulsion (5 mol % iodide, average grain diameter 1.3 microns, average grain thickness 0.10 microns) at 0.18 g, cyan dye-forming image coupler C-2 at 0.344 g, DIR compound D-1 at 0.026 g, BAR compound B-1 at 0.016 g, with gelatin at 0.94 g.

Layer 3 (Second Red-Sensitive Layer) Red sensitized silver iodobromide emulsion (3.9 mol % iodide, average grain diameter 2.1 microns, average grain thickness 0.09 microns) at 0.43 g, cyan dye-forming image coupler C-2 at 0.15 g, DIR compound D-1 at 0.016 g, BAR compound B-1 at 0.016 g, with gelatin at 0.60 g.

Layer 4 (Interlayer) Oxidized developer scavenger S-1 at 0.054 g, dye MD-1 at 0.043 g, magenta dye-forming masking coupler MM-2 at 0.15 g and 0.645 g of gelatin.

Layer 5 (First Green-Sensitive Layer) Green sensitized silver iodobromide emulsion (2.5 mol % iodide, average grain diameter 0.77 microns, average thickness 0.09 microns) at 0.269 g, magenta dye-forming image coupler M-1 at 0.086 g, magenta dye-forming image coupler M-2 at 0.26 g, DIR compound D-1 at 0.009 g with gelatin at 0.61 g.

Layer 6 (Second Green-Sensitive Layer) Green sensitized silver iodobromide emulsion (3 mol % iodide, average grain diameter 1.95 microns, average grain thickness 0.08 microns) at 0.43 g, magenta dye-forming image coupler M-1 at 0.021 g, magenta dye-forming image coupler M-2 at 0.065 g, DIR compound D-1 at 0.017 g with gelatin at 0.53 g.

Layer 7 (Interlayer) Oxidized developer scavenger S-1 at 0.054 g, yellow colloidal silver at 0.0215 g with 0.645 g of gelatin.

Layer 8 (First Blue-Sensitive Layer) Blue sensitized silver iodobromide emulsion (3.6 mol % iodide, average grain diameter 0.9 microns, average grain thickness 0.1 micron) at 0.27 g, yellow dye-forming image coupler Y-1 at 0.71 g, DIR compound D-3 at 0.022 g, with gelatin at 0.91 g.

Layer 9 (Second Blue-Sensitive Layer) Blue sensitized silver iodobromide emulsion (2.9 mol % iodide, average grain diameter 3.4 microns, average grain thickness 0.11 microns) at 0.43 g, yellow dye-forming image coupler Y-1 at 0.29 g, DIR compound D-3 at 0.011 g, with gelatin at 0.61 g.

Layer 10 (Protective Layer 1) 0.108 g of dye UV-1, 0.118 g of dye UV-2, copolymer (88:5:7 mole ratio of monomers) of n-butyl acrylate / 2-acrylamido-2-methyl propane sulfonic acid / 2-acetoacetoxyethylenemethacrylate at 2.42 g and gelatin at 0.81 g.

Layer 11 (Protective Layer 2) Unsensitized silver bromide Lippman emulsion at 0.108 g, anti-matte polymethylmethacrylate beads at 0.0538 g with gelatin at 0.71 g.

This film was hardened at coating with 2% by weight to total gelatin of hardener H-1. Surfactants, coating aids, scavengers, soluble absorber dyes and stabilizers were added to the various layers of this sample as is commonly practiced in the art.

PREPARATIVE EXAMPLE 5

Samples 109 and 110

Photographic Sample 109 was prepared in a manner similar to that used for Photographic Sample 108 by applying the following layers in the given sequence to a transparent support of cellulose triacetate.

Layer 1 (Antihalation Layer) black colloidal silver sol containing 0.236 g of silver and 2.44 g gelatin.

Layer 2 (First Red-Sensitive Layer) Red sensitized silver iodobromide emulsion (2.5 mol % iodide, average grain diameter 0.8 microns, average grain thickness 0.09 micron) at 0.70 g, cyan dye-forming image coupler C-1 at 0.538 g, DIR compound D-1 at 0.052 g, BAR compound B-1 at 0.016 g, cyan dye-forming masking coupler CM-1 at 0.068 g, with gelatin at 1.61 g.

Layer 3 (Second Red-Sensitive Layer) Red sensitized silver iodobromide emulsion (3.9 mol % iodide, average grain diameter 2.1 microns, average grain thickness 0.09 microns) at 0.65 g, cyan dye-forming image coupler C-2 at 0.29 g, DIR compound D-1 at 0.015 g, cyan dye-forming masking coupler CM-1 at 0.029 g, with gelatin at 1.09 g.

Layer 4 (Interlayer) Oxidized developer scavenger S-1 at 0.054 g, dye YD-1 at 0.086 g, and 0.645 g of gelatin.

Layer 5 (First Green-Sensitive Layer) Green sensitized silver iodobromide emulsion (2.5 mol % iodide, average grain diameter 0.77 microns, average thickness 0.09 microns) at 0.517 g, magenta dye-forming image coupler M-1 at 0.3 g, magenta dye-forming image coupler M-2 at 0.13 g, DIR compound D-1 at 0.025 g, magenta dye-forming masking coupler M-2 at 0.13 g, with gelatin at 1.16 g.

Layer 6 (Second Green-Sensitive Layer) Green sensitized silver iodobromide emulsion (3 mol % iodide, average grain diameter 1.95 microns, average grain thickness 0.08 microns) at 0.65 g, magenta dye-forming image coupler M-1 at 0.075 g, magenta dye-forming image coupler M-2 at 0.032 g, DIR compound D-2 at 0.015 g, magenta dye-forming masking coupler MM-1 at 0.017 g, with gelatin at 0.97 g.

Layer 7 (Interlayer) Oxidized developer scavenger S-1 at 0.054 g, yellow colloidal silver at 0.0215 g with 0.645 g of gelatin.

Layer 8 (First Blue-Sensitive Layer) Blue sensitized silver iodobromide emulsion (3.6 mol % iodide, average grain diameter 0.9 microns, average grain thickness 0.09 micron) at 0.43 g, yellow dye-forming image coupler Y-1 at 1.08 g, DIR compound D-3 at 0.046 g, with gelatin at 1.61 g.

Layer 9 (Second Blue-Sensitive Layer) Blue sensitized silver iodobromide emulsion (2.9 mol % iodide, average grain diameter 3.4 microns, average grain thickness 0.11 microns) at 0.65 g, yellow dye-forming image coupler Y-1 at 0.43 g, DIR compound D-3 at 0.025 g, with gelatin at 1.16 g.

Layer 10 (Protective Layer 1) 0.108 g of dye UV-1, 0.118 g of dye UV-2, and gelatin at 0.54 g.

Layer 11 (Protective Layer 2) Unsensitized silver bromide Lippman emulsion at 0.108 g, anti-matte polymethylmethacrylate beads at 0.0538 g with gelatin at 0.65 g.

This film was hardened at coating with 2% by weight to total gelatin of hardener H-1. Surfactants, coating aids, scavengers, soluble absorber dyes and stabilizers were added to the various layers of this sample as is commonly practiced in the art.

Photographic Sample 110 was prepared like Photographic Sample 109 except that the quantity of DIR compound in layer 2 was adjusted to 0.038 g, The quantity of DIR compound in layer 3 was adjusted to 0.011 g, the quantity of DIR compound in layer 5 was adjusted to 0.018 g, the quantity of DIR compound in layer 6 was adjusted to 0.015 g. the quantity of DIR compound in layer 8 was adjusted to 0.04 g, the quantity of DIR compound in layer 9 was adjusted to 0.019 g and a copolymer (88:5:7 mole ratio of monomers) of n-butyl acrylate / 2-acrylamido-2-methyl propane sulfonic acid / 2-acetoacetoxyethylenemethacrylate was added to layer 10 at 2.42 g and the quantity of gelatin in layer 10 was adjusted to 0.8 g.

PREPARATIVE EXAMPLE 6

Photographic Sample 111 was prepared in a manner similar to that used for Photographic Sample 108 by applying the following layers in the given sequence to a transparent support of cellulose triacetate.

Layer 1 (Antihalation Layer) black colloidal silver sol containing 0.236 g of silver and 2.44 g gelatin.

Layer 2 (First Red-Sensitive Layer) Red sensitized silver iodobromide emulsion (2.5 mol % iodide, average grain diameter 0.8 microns, average grain thickness 0.09 micron) at 0.36 g, red sensitized silver iodobromide emulsion (5 mol % iodide, average grain diameter 1.3 microns, average grain thickness 0.01 micron) at 0.35 g, cyan dye-forming image coupler C-2 at 0.538 g, DIR compound D-1 at 0.034 g, BAR compound B-1 at 0.022 g, with gelatin at 1.61 g.

Layer 3 (Second Red-Sensitive Layer) Red sensitized silver iodobromide emulsion (3.9 mol % iodide, average grain diameter 2.1 microns, average grain thickness 0.075 micron) at 0.74 g, cyan dye-forming image coupler C-2 at 0.22 g, DIR compound D-1 at 0.017 g, BAR compound B-1 at 0.022 g, with gelatin at 1.15 g.

Layer 4 (Interlayer) Oxidized developer scavenger S-1 at 0.054 g, dye YD-1 at 0.086 g, dye MD-1 at 0.043 g and 0.645 g of gelatin.

Layer 5 (First Green-Sensitive Layer) Green sensitized silver iodobromide emulsion (2.5 mol % iodide, average grain diameter 0.77 microns, average thickness 0.09 microns) at 0.35 g, green sensitized silver iodobromide emulsion (3 mol % iodide, average grain diameter 1.05 microns, average thickness 0.12 microns) at 0.17 g, magenta dye-forming image coupler M-1 at 0.19 g, magenta dye-forming image coupler M-2 at 0.32 g, DIR compound D-8 at 0.01 g, with gelatin at 1.16 g.

Layer 6 (Second Green-Sensitive Layer) Green sensitized silver iodobromide emulsion (3 mol % iodide, average grain diameter 1.95 microns, average thickness 0.08 microns) at 0.65 g, magenta dye-forming image coupler M-1 at 0.032 g, magenta dye-forming image coupler M-2 at 0.075 g, DIR compound D-8 at 0.015 g, with gelatin at 0.97 g.

Layer 7 (Interlayer) Oxidized developer scavenger S-1 at 0.054 g, yellow colloidal silver at 0.0215 g with 0.645 g of gelatin.

Layer 8 (First Blue-Sensitive Layer) Blue sensitized silver iodobromide emulsion (3.7 mol % iodide, average grain diameter 1 microns, average grain thickness 0.09 micron) at 0.5 g, yellow dye-forming image coupler Y-1 at 1.08 g, DIR compound D-3 at 0.038 g, BAR compound B-2 at 0.022 g with gelatin at 1.61 g.

Layer 9 (Second Blue-Sensitive Layer) Blue sensitized silver iodobromide emulsion (2.9 mol % iodide, average grain diameter 2.9 microns, average grain thickness 0.12 microns) at 0.65 g, yellow dye-forming image coupler Y-1 at 0.43 g, DIR compound D-3 at 0.019 g, BAR compound B-2 at 0.022 g with gelatin at 1.21 g.

Layer 10 (Protective Layer 1) 0.108 g of dye UV-1, 0.118 g of dye UV-2, a copolymer (88:5:7 mole ratio of monomers) of n-butyl acrylate / 2-acrylamido-2-methyl propane sulfonic acid / 2-acetoacetoxyethylenemethacrylate at 2.15 g and gelatin at 0.97 g.

Layer 11 (Protective Layer 2) Unsensitized silver bromide Lippman emulsion at 0.108 g, anti-matte polymethymethacrylate beads at 0.0538 g with gelatin at 0.54 g.

This film was hardened at coating with 2% by weight to total gelatin of hardener H-1. Surfactants, coating aids, scavengers, soluble absorber dyes and stabilizers were added to the various layers of this sample as is commonly practiced in the art.

PREPARATIVE EXAMPLE 7

Photographic Sample 112 was prepared in a manner similar to that used for Photographic Sample 111 by applying the following layers in the given sequence to a transparent support of cellulose triacetate.

Layer 1 (Antihalation Layer) black colloidal silver sol containing 0.236 g of silver, with 2.44 g gelatin.

Layer 2 (Interlayer) dye MD-1 at 0.016 g, dye CD-2 at 0.027 g, MM-2 at 0.13 g with 0.54 g gelatin.

Layer 3 (First Red-Sensitive Layer) Red sensitized silver iodobromide emulsion (3.9 mol % iodide, average grain diameter 0.6 microns, average grain thickness 0.09 micron) at 0.48 g, red sensitized silver iodobromide emulsion (5 mol % iodide, average grain diameter 1.7 microns, average grain thickness 0.08 micron) at 0.48 g, cyan dye-forming image coupler C-1 at 0.48 g, DIR compound D-9 at 0.007 g, DIR compound D-7 at 0.022 BAR compound B-1 at 0.032 g, with gelatin at 1.18 g.

Layer 4 (Second Red-Sensitive Layer) Red sensitized silver iodobromide emulsion (4.2 mol % iodide, average grain diameter 2.1 microns, average grain thickness 0.09 microns) at 1.08 g, cyan dye-forming image coupler C-2 at 0.17 g, DIR compound D-9 at 0.014 g, DIR compound D-7 at 0.027 g BAR compound B-1 at 0.011 g, cyan dye-forming masking coupler CM-1 at 0.043 g with gelatin at 1.17 g.

Layer 5 (Interlayer) Oxidized developer scavenger S-1 at 0.054 g and 1.61 g of gelatin.

Layer 6 (First Green-Sensitive Layer) Green sensitized silver iodobromide emulsion (4 mol % iodide, average grain diameter 1.4 microns, average thickness 0.09 microns) at 0.54 g, magenta dye-forming image coupler M-1 at 0.054 g. magenta dye-forming image coupler M-2 at 0.22 g, DIR compound D-9 at 0.007 g, with gelatin at 0.56 g.

Layer 7 (Second Green-Sensitive Layer) Green sensitized silver iodobromide emulsion (4 mol % iodide, average grain diameter 1.4 microns, average thickness 0.09 microns) at 0.54 g, magenta dye-forming image coupler M-1 at 0.054 g, magenta dye-forming image coupler M-2 at 0.032 g, DIR compound D-9 at 0.01 g, magenta dye-forming masking coupler MM-1 at 0.022 g with gelatin at 0.57 g.

Layer 8 (Third Green-Sensitive Layer) Green sensitized silver iodobromide emulsion (4.2 mol % iodide, average grain diameter 2 microns, average grain thickness 0.08 microns) at 1.08 g, magenta dye-forming image coupler M-1 at 0.075 g, magenta dye-forming masking coupler MM-1 at 0.022 g, DIR compound D-9 at 0.012 g, with gelatin at 1.08 g.

Layer 9 (Interlayer) Oxidized developer scavenger S-1 at 0.054 g, dye YD-2 at 0.22 g with 1.61 g of gelatin.

Layer 10 (First Blue-Sensitive Layer) Blue sensitized silver iodobromide emulsion (4 mol % iodide, average grain diameter 0.1 microns, average grain thickness 0.09 micron) at 0.32 g, blue sensitized silver iodobromide emulsion (4 mol % iodide, average grain diameter 1.3 microns, average grain thickness 0.09 micron) at 0.11 g, yellow dye-forming image coupler Y-1 at 0.84 g, DIR compound D-3 at 0.032 g, BAR compound B-2 at 0.032 g with gelatin at 1.11 g.

Layer 11 (Second Blue-Sensitive Layer) Blue sensitive silver iodobromide emulsion (6 mol % iodide, average grain diameter 1.9 microns, average grain thickness 0.35 microns) at 0.65 g, yellow dye-forming image coupler Y-1 at 0.2 g, DIR compound D-3 at 0.032 g, DIR compound D-10 at 0.002 g, with gelatin at 0.86 g.

Layer 12 (Protective Layer 1) 0.108 g of dye UV-1, 0.118 g of dye UV-2, dye CD-2 at 0.0065 g, unsensitized silver bromide Lippman emulsion at 0.108 g, with gelatin at 0.54 g.

Layer 13 (Protective Layer 2) Anti-matte polymethylmethacrylate beads at 0.0538 g with gelatin at 0.54 g.

This film was hardened at coating with 2% by weight to total gelatin of hardener H-1. Surfactants, coating aids scavengers, soluble absorber dyes and stabilizers were added to the various layers of this sample as is commonly practiced in the art.

PREPARATIVE EXAMPLE 8

Samples 113 to 126

Photographic Sample 113 was prepared in a manner similar to that used for Photographic Sample 112 by applying the following layers in the given sequence to a transparent support of cellulose triacetate.

Layer 1 (Antihalation Layer) black colloidal silver sol containing 0.236 g of silver, with 2.44 g gelatin.

Layer 2 (Interlayer) dye MD-1 at 0.016 g, dye CD-2 at 0.027 g, MM-2 at 0.13 g with 0.54 g gelatin.

Layer 3 (First Red-Sensitive Layer) Red sensitized silver iodobromide emulsion (3.9 mol % iodide, average grain diameter 0.6 microns, average grain thickness 0.09 micron) at 0.16 g, red sensitized silver iodobromide emulsion (5 mol % iodide, average grain diameter 1.7 microns, average grain thickness 0.08 micron) at 0.16 g, cyan dye-forming image coupler C-1 at 0.48 g, DIR compound D-9 at 0.003 g, DIR compound D-7 at 0.011, BAR compound B-1 at 0.032 g, with gelatin at 1.18 g.

Layer 4 (Second Red-Sensitive Layer) Red sensitized silver iodobromide emulsion (4.2 mol % iodide, average grain diameter 2.1 microns, average grain thickness 0.09 microns) at 0.48 g, cyan dye-forming image coupler C-2 at 0.17 g, DIR compound at D-9 at 0.007 g, DIR compound D-7 at 0.011 g BAR compound B-1 at 0.011 g, cyan dye-forming masking coupler CM-1 at 0.043 g with gelatin at 1.17 g.

Layer 5 (Interlayer) Oxidized developer scavenger S-1 at 0.054 g and 1.61 g of gelatin.

Layer 6 (First Green-Sensitive Layer) Green sensitized silver iodobromide emulsion (2.6 mol % iodide, average grain diameter 0.6 microns, average thickness 0.09 microns) at 0.22 g, magenta dye-forming image coupler M-1 at 0.054 g, magenta dye-forming image coupler M-2 at 0.22 g, DIR compound D-9 at 0.002 g, with gelatin at 0.56 g.

Layer 7 (Second Green-Sensitive Layer) Green sensitized silver iodobromide emulsion (4 mol % iodide, average grain diameter 1.4 microns, average thickness 0.09 microns) at 0.22 g, magenta dye-forming image coupler M-1 at 0.054 g, magenta dye-forming image coupler M-2 at 0.32 g, DIR compound D-9 at 0.003 g, magenta dye-forming masking coupler MM-1 at 0.022 g with gelatin at 0.57 g.

Layer 8 (Third Green-Sensitive Layer) Green sensitized silver iodobromide emulsion (4.2 mol % iodide, average grain diameter 2 microns, average grain thickness 0.08 microns) at 0.43 g, magenta dye-forming image coupler M-1 at 0.065 g, magenta dye-forming masking coupler MM-1 at 0.022 g, DIR compound D-9 at 0.005 g, with gelatin at 1.08 g.

Layer 9 (Interlayer) Oxidized developer scavenger S-1 at 0.054 g, dye YD-2 at 0.22 g with 1.61 g of gelatin.

Layer 10 (First Blue-Sensitive Layer) Blue sensitive silver iodobromide emulsion (4 mol % iodide, average grain diameter 0.1 microns, average grain thickness 0.09 micron) at 0.27 g, blue sensitive silver iodobromide emulsion (4 mol % iodide, average grain diameter 1.3 microns, average grain thickness 0.09 micron) at 0.054 g, yellow dye-forming image coupler Y-1 at 0.65 g, DIR compound D-3 at 0.022 g, BAR compound B-2 at 0.022 g with gelatin at 1.11 g.

Layer 11 (Second Blue-Sensitive Layer) Blue sensitive silver iodobromide emulsion (3 mol % iodide, average grain diameter 2.5 microns, average grain thickness 0.12 microns) at 0.38 g, yellow dye-forming image coupler Y-1 at 0.2 g, DIR compound D-3 at 0.011 g, DIR compound D-10 at 0.001 g, BAR compound B-2 at 0.011 g with gelatin at 0.86 g.

Layer 12 (Protective Layer 1) 0.108 g of dye UV-1, 0.118 g of dye UV-2, dye CD-2 at 0.0065 g, unsensitized silver bromide Lippman emulsion at 0.108 g, with gelatin at 0.54 g.

Layer 13 (Protective Layer 2) Anti-matte polymethylmethacrylate beads at 0.0538 g with gelatin at 0.54 g.

This film was hardened at coating with 2% by weight to total gelatin of hardener H-1. Surfactants, coating aids, scavengers, soluble absorber dyes and stabilizers were added to the various layers of this sample as is commonly practiced in the art.

Photographic Samples 114 through 126 were prepared in a manner analogous to that described above. For these samples, the total quantities of vehicle and incorporated silver are listed in Table I. Also listed in Table I are the largest emulsion Tabularity value associated with an emulsion used in each photographic sample.

PREPARATIVE EXAMPLE 9

Photographic Sample 127 was prepared in a manner similar to that used for Photographic Sample 112 by applying the following layers in the given sequence to a transparent support of cellulose triacetate.

Layer 1 (Antihalation Layer) black colloidal silver sol containing 0.236 g of silver, with 2.44 g gelatin.

Layer 2 (First Red-Sensitive Layer) Red sensitized silver iodobromide emulsion (3.9 mol % iodide, average grain diameter 0.6 microns, average grain thickness 0.09 micron) at 0.19 g, cyan dye-forming image coupler C-2 at 0.33 g, DIR compound D-1 at 0.005 g, BAR compound B-1 at 0.011 g, with gelatin at 0.61 g.

Layer 3 (Second Red-Sensitive Layer) Red sensitized silver iodobromide emulsion (5 mol % iodide, average grain diameter 1.2 microns, average grain thickness 0.1 micron) at 0.19 g, cyan dye-forming image coupler C-1 at 0.16 g, DIR compound at D-1 at 0.01 g, BAR compound B-1 at 0.011 g, with gelatin at 0.50 g.

Layer 4 (Third Red-Sensitive Layer) Red sensitized silver iodobromide emulsion (4.2 mol % iodide, average grain diameter 2.1 microns, average grain thickness 0.09 microns) at 0.5 g, cyan dye-forming image coupler C-1 at 0.19 g, DIR compound D-1 at 0.01 g, BAR compound B-1 at 0.011 g, with gelatin at 0.58 g.

Layer 5 (Interlayer) Oxidized developer scavenger S-1 at 0.054 g, dye MD-1 at 0.108 g. dye YD-1 at 0.15 g, incorporated accelerator A-1 at 0.086 g and 0.65 g of gelatin.

Layer 6 (First Green-Sensitive Layer) Green sensitized silver iodobromide emulsion (2.6 mol % iodide, average grain diameter 0.65 microns, average thickness 0.09 microns) at 0.14 g, magenta dye-forming image coupler M-1 at 0.13 g, magenta dye-forming image coupler M-2 at 0.11 g, DIR compound D-1 at 0.005 g, with gelatin at 0.45 g.

Layer 7 (Second Green-Sensitive Layer) Green sensitized silver iodobromide emulsion (4 mol % iodide, average grain diameter 1.2 microns, average thickness 0.09 microns) at 0.22 g, magenta dye-forming image coupler M-1 at 0.065 g, magenta dye-forming image coupler M-2 at 0.27 g, DIR compound D-1 at 0.027 g, with gelatin at 0.43 g.

Layer 8 (Third Green-Sensitive Layer) Green sensitized silver iodobromide emulsion (4.2 mol % iodide, average grain diameter 2 microns, average grain thickness 0.07 microns) at 0.43 g, magenta dye-forming image coupler M-1 at 0.048 g, DIR compound D-2 at 0.009 g, with gelatin at 0.53 g.

Layer 9 (Interlayer) Oxidized developer scavenger S-1 at 0.054 g, yellow colloidal silver at 0.21 g with 0.65 g of gelatin.

Layer 10 (First Blue-Sensitive Layer) Blue sensitive silver iodobromide emulsion (4 mol % iodide, average grain diameter 0.1 microns, average grain thickness 0.09 micron) at 0.33 g, yellow dye-forming image coupler Y-1 at 0.65 g, DIR compound D-3 at 0.016 g, DIR compound D-10 at 0.003 g, BAR compound B-2 at 0.032 g with gelatin at 0.86 g.

Layer 11 (Second Blue-Sensitive Layer) Blue sensitive silver iodobromide emulsion (2.9 mol % iodide, average grain diameter 2.8 microns, average grain thickness 0.12 microns) at 0.43 g, yellow dye-forming image coupler Y-1 at 0.22 g, DIR compound D-3 at 0.005 g, DIR compound D-10 at 0.001 g, BAR compound B-2 at 0.011 g with gelatin at 0.52 g.

Layer 12 (Protective Layer 1) 0.108 g of dye UV-1, 0.118 g of dye UV-2, copolymer (88:5:7 mole ratio of monomers) of n-butyl acrylate / 2-acrylamido-2-methyl propane sulfonic acid / 2-acetoacetoxyethylenemethacrylate at 2.15 g with gelatin at 0.97 g.

Layer 13 (Protective Layer 2) Anti-matte polymethylmethacrylate beads at 0.0538 g, unsensitized silver bromide Lippman emulsion at 0.108 g, with gelatin at 0.54 g.

This film was hardened at coating with 2% by weight to total gelatin of hardener H-1. Surfactants, coating aids, scavengers, soluble absorber dyes and stabilizers were added to the various layers of this sample as is commonly practiced in the art.

Structures of Compounds Used In Photographic Samples

C-1

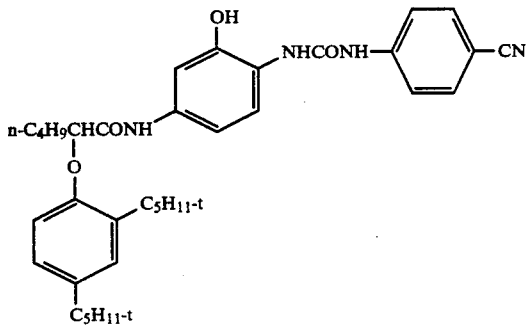

C-2

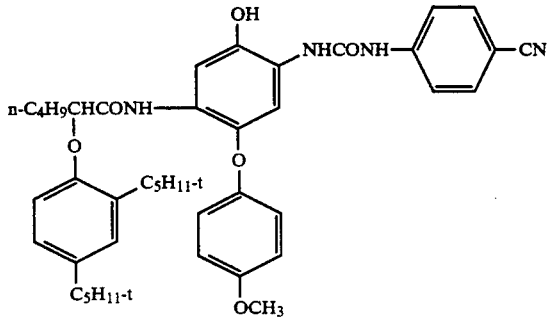

-continued
Structures of Compounds Used In Photographic Samples
D-1
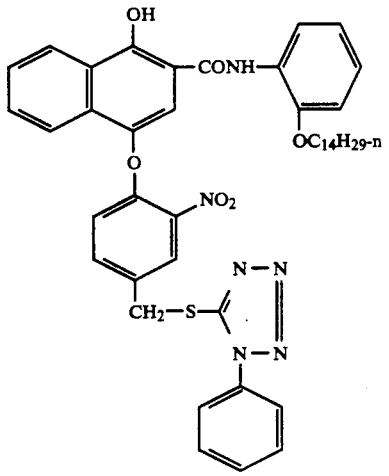
S-1
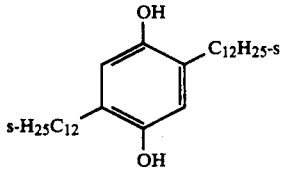
M-1
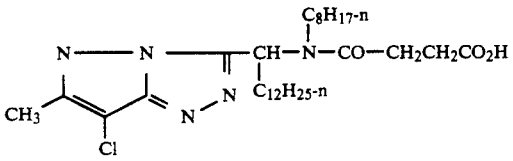
M-2
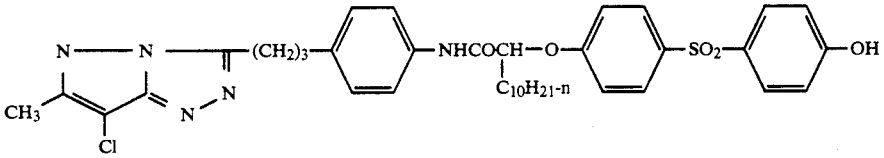
D-2
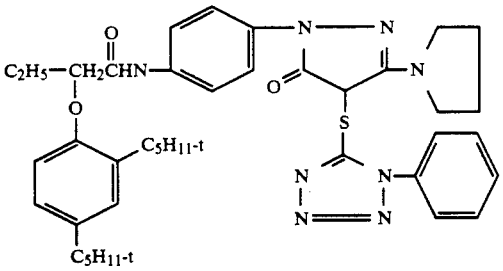
Y-1
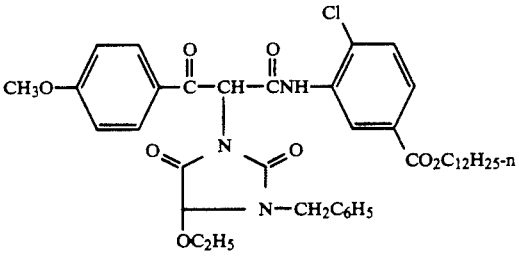
D-3
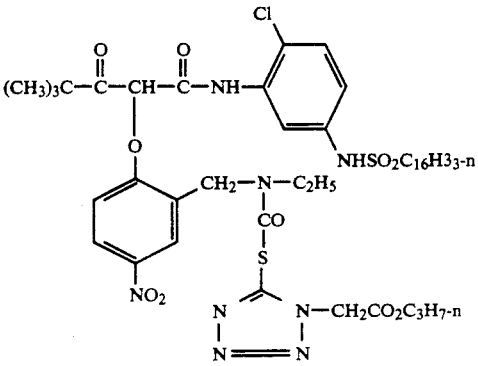
B-1
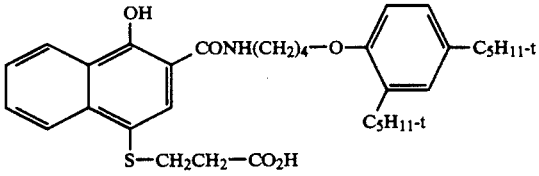

-continued
Structures of Compounds Used In Photographic Samples
CM-1
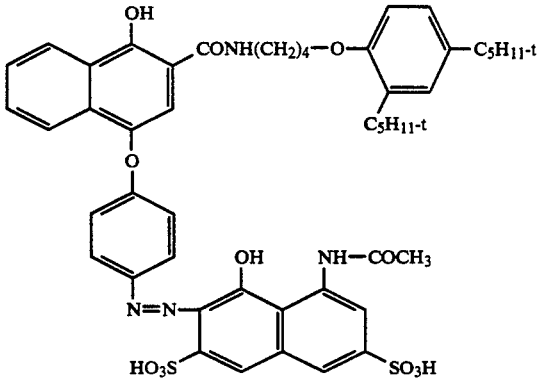
MM-1
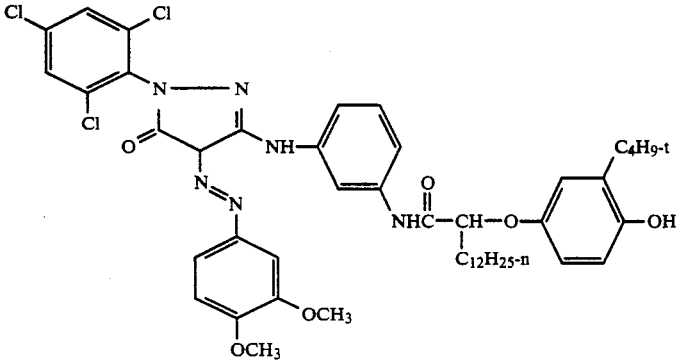
YD-1
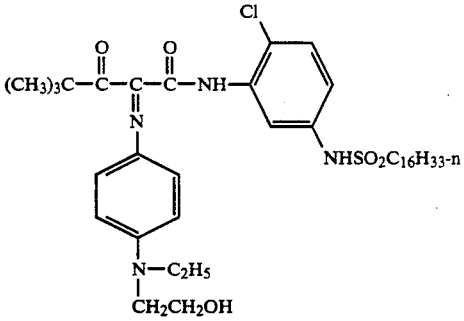
UV-1
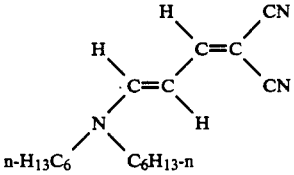
UV-2
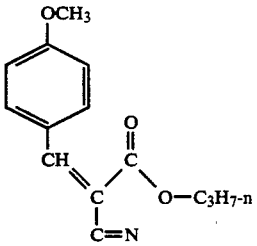
D-4
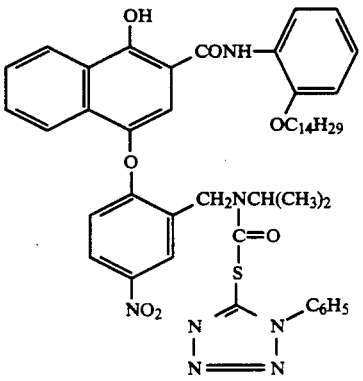

-continued
Structures of Compounds Used In Photographic Samples
Y-2
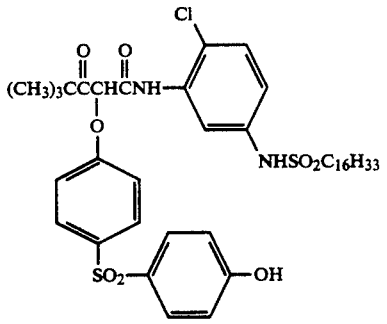
MD-1
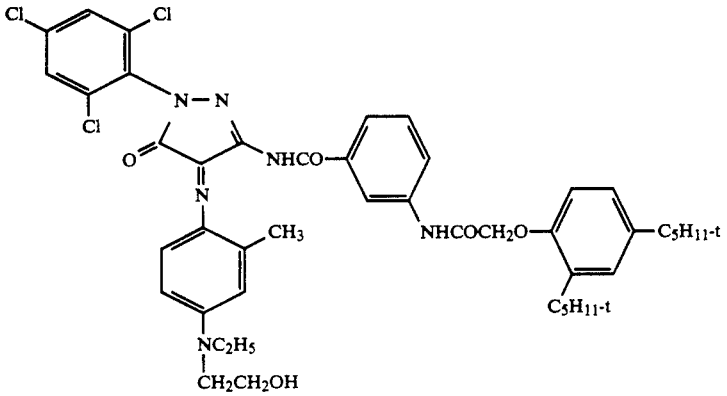
CD-1
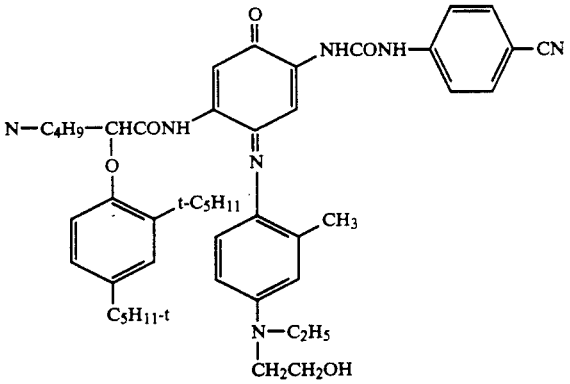
D-6
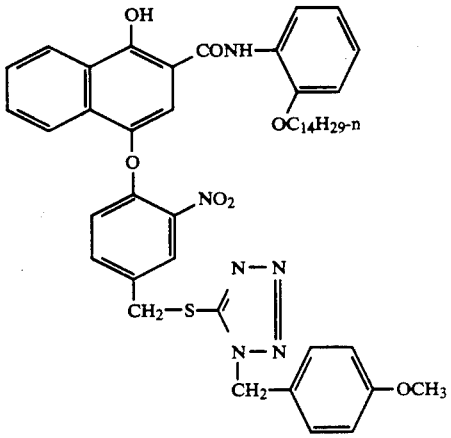
D-5
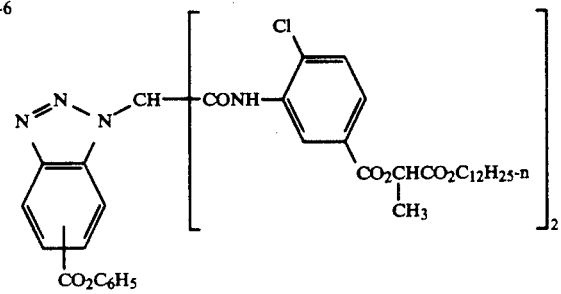

-continued
Structures of Compounds Used In Photographic Samples
D-7
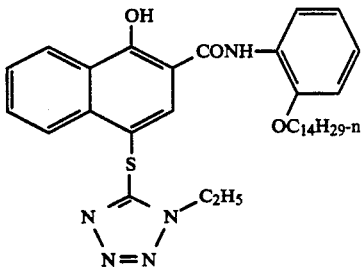
S-2
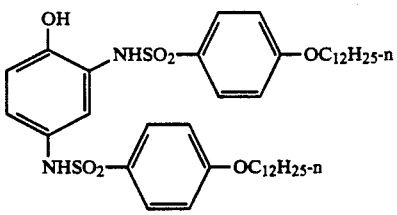
MM-2
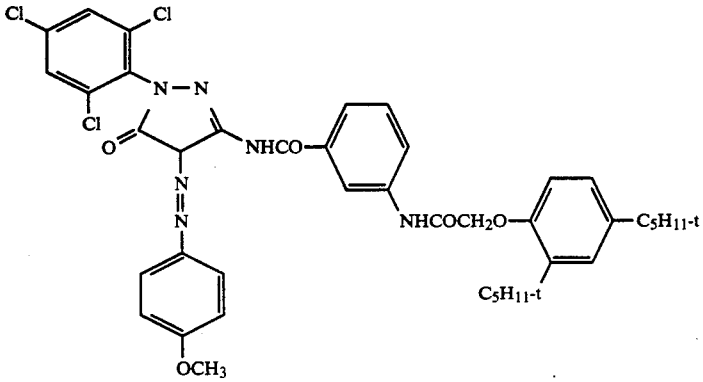
D-8
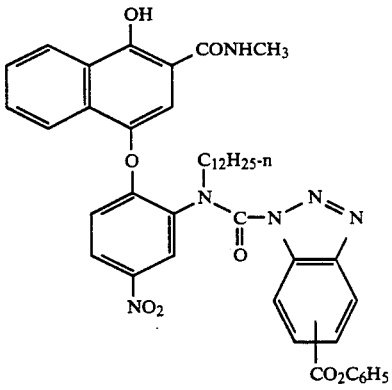
B-2
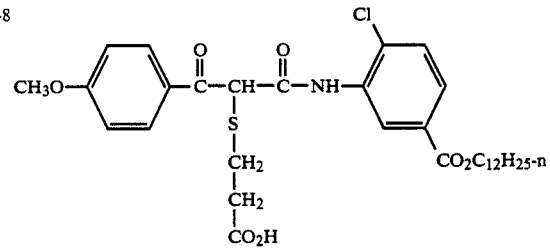
CD-2
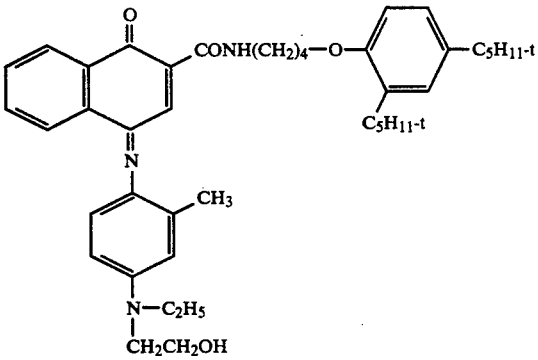
D-9
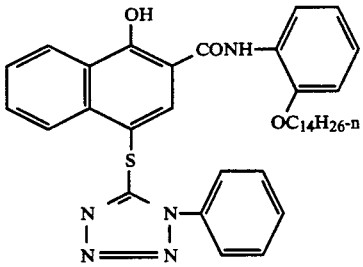
YD-2
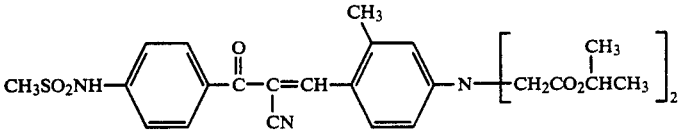

-continued

Structures of Compounds Used In Photographic Samples

D-10

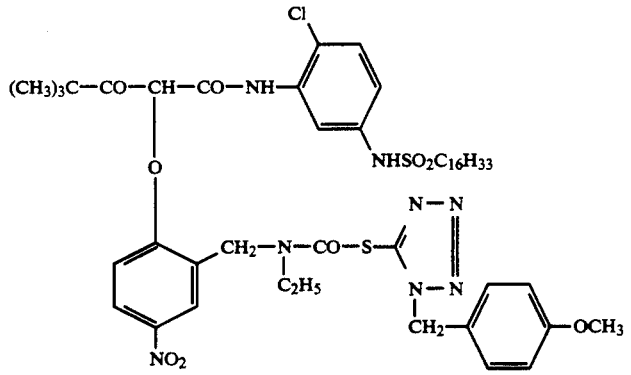

A-1

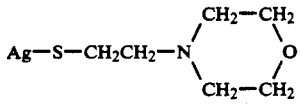

H-1

EXAMPLE 10

The quantity of silver incorporated in unprocessed strips of Photographic Sample 101 through 127 was measured by x-ray fluorescence to determine the initial silver content of each sample.

Photographic Samples 101 through 127 were then exposed to white light through a graduated density test object and treated with Color Negative Process A as outlined below. Color Negative Process A includes a greatly abbreviated contact (⅓ of the time) with a peracid bleach bath as compared to similar processes described in the art. (See for example, Example 5 as disclosed in U.S. Pat. No. 4,780,403.)

| PROCESS A | |
|---|---|
| DEVELOP (color developer) | 3:15 at 38° C. |
| STOP (acid) | 1:00 |
| WATER WASH | 1:00 |
| BLEACH PRE-BATH (accelerator bath) | 0:30 |
| BLEACH (persulfate bleach) | 1:00 |
| WATER WASH | 1:00 |
| FIX | 4:00 |
| WATER WASH | 3:00 |
| STABILIZER | 1:00 |
| **Developer** | |
| Water | 800.0 mL |
| Potassium carbonate, anhydrous | 34.30 g |
| Potassium bicarbonate | 2.32 g |
| Sodium sulfite, anhydrous | 4.06 g |
| Potassium iodide | 1.20 mg |
| Sodium bromide | 1.31 g |
| Diethylenetriaminepentaacetic acid, pentasodium salt | 3.37 g |
| Hydroxylamine sulfate (HAS) | 2.41 g |
| KODAK Color Developing Agent CD-4 | 4.52 g |
| Water to make | 1.00 L |
| pH @ 80° F. 10.00 +/− 0.05 | |
| **Stop Bath** | |
| Water | 900.0 mL |
| Sulfuric acid (18M) | 10.00 mL |
| Water to make | 1.00 L |
| pH @ 80° F. 0.90 | |
| **Bleach Accelerator** | |
| Water | 900.0 mL |
| Sodium metabisulfite (anhydrous) | 3.50 g |
| Glacial acetic acid | 5.00 mL |
| (Ethylendinitrilo)tetraacetic acid, tetrasodium salt | 0.50 g |
| Dimethylaminoethanethiol, isothiouronium salt) | 3.50 g |

-continued

| PROCESS A | |
|---|---|
| Sulfuric acid (18M) | 0.80 mL |
| Water to make | 1.00 L |
| pH @ 80° F. 4.00 +/− 0.2 | |
| **Persulfate Bleach** | |
| Water | 800.0 mL |
| Gelatin hydrolysate | 0.50 g |
| Sodium persulfate | 33.00 g |
| Sodium chloride | 15.00 g |
| Sodium dihydrogen phosphate (anhydrous) | 9.00 g |
| Phosphoric acid (85% solution) | 2.50 mL |
| Water to make | 1.00 L |
| pH @ 80° F. 2.30 +/− 0.20 | |
| Adjusted with phosphoric acid | |
| **Fix** | |
| Water | 500.0 mL |
| Ammonium thiosulfate (56.5% ammonium thiosulfate, 4% ammonium sulfite) | 162.0 mL |
| Sodium metabisulfite | 11.85 g |
| Sodium hydroxide (50% solution) | 2.00 mL |
| Water to make | 1.00 L |
| pH @ 80° F. 6.50 +/− 0.05 | |
| Adjusted with NaOH or glacial acetic acid | |
| **Stabilizer** | |
| Water | 800.0 mL |
| Formaldehyde (37% solution, 12% MeOH) | 3.60 g |
| Silwet L-7607 (Union Carbide) | 0.83 g |
| Water to make | 1.00 L |

After the processed films were dried, the residual silver content at a Dmax region was measured by X-ray fluorescence. For each film, the quantity of incorporated vehicle (gelatin plus any gel extenders) was calculated based on the starting formulation. The tabularity of the incorporated emulsions was also calculated from the average physical dimensions (circular diameter and thickness) of the emulsions. Table 1 lists the Initial Silver Content of each Photographic Sample (in grams per square meter), the residual silver content after an exposure sufficient to form maximum color density (Dmax) and treatment with Color Negative Process A (in grams per square meter), and the largest tabularity value of an emulsion incorporated in each sample (in reciprocal microns).

Each film sample is additionally identified as to High Sensitivity using the criteria previously described. Each sample was judged as being successfully desilvered when the quantity of residual silver was less than 0.20 grams per square meter in a Dmax region when processed as described above.

TABLE 1

Desilvering of Photographic Sample 101 through 127

| RATIO HIGHEST T / LOWEST T | Sample | Initial Silver | Residual Silver | Initial Vehicle | Tabularity High → Low | High Speed |
|---|---|---|---|---|---|---|
| 5.2 | 101 I | 4.75 | 0.011 | 13.45 | 382 → 74 | Y |
| 5.2 | 102 I | 5.27 | 0.032 | 13.45 | 382 → 74 | Y |
| 5.2 | 103 I | 5.44 | 0.021 | 13.45 | 382 → 74 | Y |
| 5.2 | 104 I | 5.67 | 0.086 | 13.45 | 382 → 74 | Y |
| 5.2 | 105 I | 6.03 | 0.172 | 13.45 | 382 → 74 | Y |
| 33.3 | 106 C | 8.78 | 0.603 | 18.32 | 300 → 9 | Y |
| 35.2 | 107 C | 7.22 | 0.463 | 16.32 | 116 → 3.3 | N |
| 3.55 | 108 I | 2.66 | 0.007 | 9.44 | 305 → 86 | Y |
| 3.21 | 109 I | 3.86 | 0.011 | 12.63 | 305 → 95 | Y |
| 3.21 | 110 I | 3.86 | 0.021 | 12.89 | 305 → 95 | Y |
| 3.94 | 111 I | 4.06 | 0.016 | 12.93 | 374 → 95 | Y |
| 26 | 112 I | 5.49 | 0.215 | 13.81 | 312 → 12 | Y |
| 26 | 113 I | 2.78 | 0.011 | 13.81 | 312 → 12 | Y |
| 2.7 | 114 C | 7.18 | 0.258 | 14.79 | 30 → 11 | N |
| | 115 C | 10.32 | 0.495 | 20.79 | 230 | Y |
| 49 | 116 C | 4.49 | 0.280 | 15.66 | 98 → 2 | N |
| | 117 C | 9.04 | 0.467 | 20.83 | 230 | Y |
| 33.3 | 118 C | 8.34 | 0.586 | 19.42 | 300 → 9 | Y |
| 8.6 | 119 C | 7.37 | 0.382 | 19.87 | 138 → 16 | Y |
| 3.51 | 120 I | 2.61 | 0.004 | 11.86 | 302 → 86 | Y |
| 3.34 | 121 I | 3.92 | 0.011 | 12.99 | 317 → 95 | Y |
| 3.34 | 122 I | 2.90 | 0.005 | 12.97 | 317 → 95 | Y |
| 3.34 | 123 I | 3.95 | 0.011 | 14.60 | 317 → 95 | Y |
| 3.51 | 124 I | 2.66 | 0.007 | 12.18 | 302 → 86 | Y |
| 4.12 | 125 I | 3.62 | 0.014 | 12.32 | 305 → 74 | Y |
| 8.63 | 126 I | 3.04 | 0.011 | 12.32 | 138 → 16 | Y |
| 34 | 127 I | 2.82 | 0.011 | 9.70 | 408 → 12 | Y |
| 3.0 | *5247 C | 6.96 | 0.065 | 11.30 | 26 → 8.6 | N |
| 48 | *5295 C | 8.30 | 0.216 | 13.62 | 280 → 5.8 | Y |
| 1.3 | *5245 C | 6.20 | 0.043 | 13.22 | 76 → 60 | N |
| | *5296 C | 9.29 | 0.355 | 14.98 | | Y |
| 4.1 | *5248 C | 7.16 | 0.054 | 13.54 | 193 → 47 | N |

Footnotes to Table 1:
C indicates a control sample.
I indicates an inventive sample.
Y indicates Photographic Speed greater than ISO 180, i.e. a High Sensitivity Film.
T is Tabularity.
*Kodak Eastman Color Negative family of films.

As is readily apparent on examination of the results reported in Table 1, high speed photographic samples in which the quantity of incorporated silver and incorporated vehicle is less than 20 g/m$^2$ of film are desilvered whereas, conversely, high speed photographic samples in which the quantity of incorporated silver exceeds 20 g/m$^2$ film retain excessive quantities of residual silver. This residual silver greatly degrades color reproduction and color saturation in these films.

EXAMPLE 11

Several of the Photographic Samples previously described were exposed to white light through a graduated density test object and developed and bleached according to the C-41 process as described in the British Journal of Photography Annual for 1988 at pages 196–198. This process employs a Ferric Ethylenediamine bleach commonly used in commerce. It is listed here as Process B. The quantity of residual silver in the samples following Process B was measured using x-ray fluorescence techniques. The quantities of residual silver observed in these samples after Process A as well as to the quantity of residual silver observed after Process B are listed in Table 2 (both quantities in grams per square meter).

TABLE 2

Residual Silver After Process A and Process B

| Sample | Process A Residual Silver | Process B Residual Silver |
|---|---|---|
| 106 C | 0.603 | 0.075 |
| 107 C | 0.463 | 0.161 |
| 118 C | 0.586 | 0.065 |
| 108 I | 0.007 | 0.097 |
| 109 I | 0.011 | 0.129 |
| 110 I | 0.021 | 0.140 |
| 111 I | 0.016 | 0.151 |

C indicates a control sample
I indicates an inventive sample
Process A employs a peracid bleach
Process B employs a Ferric ion chelated bleach Several important features are apparent from the data shown in Table 2. First, the inventive and control samples exhibit quite similar quantities of residual silver in Process B. Second, the control samples exhibit substantially larger quantities of residual silver in Process A than in Process B. It is clear that sample desilvering in Process B is not predictive of sample desilvering in Process A. Apparently, the film design parameters which control desilvering in a process comprising a ferric ion chelated bleach differ from those which control desilvering in a process comprising a peracid bleach.

EXAMPLE 12

Photographic Sample 127 was exposed to white light through a graduated density test object and treated with Process C and D as described below. The quantity of residual silver after exposure sufficient to enable attainment of maximum dye density after processing was measured by x-ray fluorescence silver analysis.

Process C is like Process A, described earlier, except that the Bleach Pre-Bath (accelerator bath) is omitted. Process D is like Process C except that the Bleach time is 2 minutes.

Photographic Sample 127 which comprises the incorporated accelerator A-1 according to U.S. Pat. No. 4,865,956, exhibited a residual silver amount of 0.09 grams per square meter after Process C and exhibited no measurable residual silver after Process D. Photographic Sample 118 was employed as a control sample in this example. It exhibited a residual silver amount of 1.46 grams per square meter after Process C and exhibited a residual silver amount of 1.41 grams per square meter after Process D.

This example illustrates that the inventive film compositions which comprise an incorporated bleach accelerator may be used to advantage in peracid bleach processes which do not comprise an accelerator bath.

The invention has been described in detail with particular reference to preferred embodiments thereof, but it will be understood that variations and modifications can be effected within the spirit and scope of the invention.

What is claimed is:

1. A method of processing a negative color silver halide photographic element comprising taking an exposed color silver halide photographic element with a speed greater than ISO 180 or containing at least one spectrally sensitized silver halide emulsion with a tabularity greater than 100, wherein the photographic element comprises a total amount of incorporated silver and incorporated vehicle of 20 g/m$^2$ film or less;

developing the exposed photographic element; and bleaching the exposed, developed photographic element with a peracid bleach in the presence of a bleach accelerator which accelerates peracid bleaches.

2. The method of claim 1 wherein the silver halide photographic element has a speed greater than ISO 180.

3. The method of claim 1 wherein the silver halide photographic element contains at least one spectrally sensitized silver halide emulsion with a tabularity greater than 100.

4. The method of claim 1 wherein the peracid bleach is a persulfate bleach.

5. The method of claim 4 wherein the persulfate bleach is a sodium, potassium, or ammonium persulfate bleach.

6. The method of claim 1 wherein the amount of vehicle is 2 to 15 g/m$^2$.

7. The method of claim 1 wherein the photographic material is bleached for 20 to 260 seconds.

8. The method of claim 1 wherein the photographic material is bleached for 20 to 120 seconds.

9. The method of claim 1 wherein the concentration of the peracid is 0.01 to 1.0 moles/liter.

10. The method of claim 1 wherein the concentration of the peracid is 0.05 to 0.50 moles/liter.

11. The method of claim 1 wherein the amount of silver is less than 10 g/m$^2$ of film.

12. The method of claim 1 wherein the amount of silver is less than 5 g/m$^2$ of film.

13. The method of claim 1 wherein the photographic element comprises the bleach accerator or a precursor thereof.

14. The method of claim 13 wherein the concentration of the bleach accelerator is 0.05 to 0.5 g/m$^2$.

15. The method of claim 1 wherein the spectrally sensitized silver halide emulsion comprises iodide.

16. The method of claim 1 wherein the bleach accelerator is contained in a bleach pre-bath or the bleaching solution.

17. The method of claim 16 wherein the concentration of the bleach accelerator is 0.005 to 0.05 moles/liter.

18. The method of claim 1 wherein the spectrally sensitized silver halide emulsion has a tabularity greater than 200.

19. A method of processing a negative color silver halide photographic element comprising taking an exposed color silver halide photographic element with a speed greater than ISO 180 or containing at least one spectrally sensitized silver halide emulsion with a tabularity greater than 100, wherein the photographic element comprises a total amount of incorporated silver and incorporated vehicle of 20 g/m$^2$ film or less with the amount of vehicle being 2 to 15 g/m$^2$ and the amount of silver being less than 10 g/m$^2$;

developing the photographic element; and bleaching the exposed developed photographic element in a sodium, potassium, or ammonium persulfate bleach in the presence of a bleach accelerator which accelerates peracid bleaches for 20 to 260 seconds, wherein the concentration of the persulfate is 0.01 to 1.0 moles/liter.

20. The method of claim 19 wherein the silver halide photographic element has a speed greater than ISO 180.

21. The method of claim 19 wherein the silver halide photographic element contains at least one spectrally sensitized silver halide emulsion with a tabularity greater than 100.

22. The method of claim 19 wherein the concentration of the persulfate is 0.05 to 0.50 moles/liter.

23. The method of claim 19 wherein the amount of silver is less than 5 g/m$^2$ of film.

24. The method of claim 19 wherein the photographic element comprises the bleach accelerator or a precursor thereof.

25. The method of claim 24 wherein the concentration of the bleach accelerator is 0.05 to 0.5 g/m$^2$.

26. The method of claim 19 wherein the spectrally sensitized silver halide emulsion comprises iodide.

27. The method of claim 19 wherein the bleach accelerator is contained in a bleach pre-bath or the bleaching solution.

28. The method of claim 27 wherein the concentration of the bleach accelerator is 0.005 to 0.05 moles/liter.

29. The method of claim 21 wherein the spectrally sensitized silver halide emulsion has a tabularity greater than 200.

* * * * *